US008672280B2

(12) United States Patent
Suciu et al.

(10) Patent No.: US 8,672,280 B2
(45) Date of Patent: Mar. 18, 2014

(54) ELONGATED TRACK SUPPORT ARRANGEMENT

(75) Inventors: Rebecca C. Suciu, Lynn, MA (US); Thomas P. Burrous, Haverhill, MA (US); David E. Pitcher, Swampscott, MA (US); Alan L. Stenfors, Scituate, MA (US); Sidney Rose, Marblehead, MA (US)

(73) Assignee: Rose Displays Ltd, Salem, MA (US)

( * ) Notice: Subject to any disclaimer, the term of this patent is extended or adjusted under 35 U.S.C. 154(b) by 162 days.

(21) Appl. No.: 12/932,569

(22) Filed: Feb. 28, 2011

(65) Prior Publication Data

US 2012/0217366 A1 Aug. 30, 2012

(51) Int. Cl.
*A47H 1/10* (2006.01)
*E04C 3/00* (2006.01)

(52) U.S. Cl.
USPC ..... 248/323; 248/342; 248/343; 248/489; 52/848; 52/586.1; 40/617; 403/292

(58) Field of Classification Search
USPC ..... 248/317, 320, 321, 323, 324, 327, 328, 248/329, 332, 343, 339, 340, 489, 490, 494, 248/322, 342; 40/617, 601; 403/292, 297, 403/187; 211/113, 116, 117, 119; 52/848, 52/586.1, 586.2, 585.1, 655.1
See application file for complete search history.

(56) References Cited

U.S. PATENT DOCUMENTS 3,043,408 A * 7/1962 Attwood ..... 52/842
3,061,055 A * 10/1962 Nijhuis ..... 403/7
3,235,920 A * 2/1966 Davis ..... 52/586.1
3,374,703 A * 3/1968 Davis et al. ..... 411/466
3,427,054 A * 2/1969 Bergman ..... 403/377
3,458,052 A * 7/1969 Kann ..... 211/193
3,778,175 A * 12/1973 Zimmer ..... 403/187
4,159,758 A * 7/1979 Courson ..... 198/335
4,344,244 A * 8/1982 Tyke ..... 40/611.05
4,570,408 A * 2/1986 Frascaroli et al. ..... 52/843
5,007,222 A * 4/1991 Raymond ..... 52/586.1
5,144,780 A * 9/1992 Gieling et al. ..... 52/298
5,203,135 A * 4/1993 Bastian ..... 52/848
5,326,204 A * 7/1994 Carlson et al. ..... 410/143
5,409,191 A * 4/1995 Wenmaekers ..... 248/317
5,414,971 A * 5/1995 Handte ..... 52/506.06
D363,997 S * 11/1995 Nomura ..... D25/122
5,557,902 A * 9/1996 Witmyer ..... 52/506.07
5,657,604 A * 8/1997 Malott ..... 52/655.1
5,806,823 A * 9/1998 Callas ..... 248/320
6,675,545 B2 * 1/2004 Chen et al. ..... 52/586.1
6,807,791 B2 * 10/2004 Herb ..... 52/846
7,634,891 B2 * 12/2009 Fanucci et al. ..... 52/843
7,743,541 B2 * 6/2010 Suciu et al. ..... 40/658
7,823,311 B2 * 11/2010 Pitcher et al. ..... 40/790
7,866,098 B2 * 1/2011 Cinnamon ..... 52/173.3
7,997,207 B2 * 8/2011 Hess ..... 104/95
8,070,122 B2 * 12/2011 Suciu et al. ..... 248/324
8,104,207 B2 * 1/2012 Pitcher et al. ..... 40/617
2008/0202007 A1 * 8/2008 Suciu et al. ..... 40/658

FOREIGN PATENT DOCUMENTS

EP 333907 A2 * 9/1989 ..... A47G 1/16

* cited by examiner

*Primary Examiner* — Kimberly Wood
(74) *Attorney, Agent, or Firm* — Don Halgren

(57) ABSTRACT

A system for supporting a display arrangement from an overhead support, comprising: an elongated support rail having an elongated open upper channel for receipt of an overhead support member; an elongated lower channel for receipt of a lower display support member; and an elongated middle channel disposed between the upper channel and the lower channel for aligned, guided and captured receipt of an elongated connector member to permit the connection to an adjacent elongated support rail or track.

13 Claims, 8 Drawing Sheets

ELONGATED TRACK SUPPORT ARRANGEMENT

BACKGROUND OF THE INVENTION

1. Field of the Invention

This invention relates to overhead track support systems for displaying media and the like, from ceilings in commercial establishments in a more efficient manner than that of the prior art, and is a continuation in part application of Rose-36, entitled "Scissor-action support arrangement", filed Nov. 3, 2009, and is incorporated herein by reference in its entirety.

2. Discussion of the Prior Art

U.S. Pat. No. 7,712,239, to Pitcher et al, also incorporated herein by reference, shows an overhead adjustable track support arrangement which is attached to an overhead support in a ceiling or the like. There are times however when an elongated support track or rail cannot be mounted directly to a ceiling. There are other times, when it is desirable to utilize a very long track as an overhead support in a commercial establishment, or to utilize a track in a window display, wherein the elongated track may not be attachable to an overhead or ceiling because of some form of track lighting or other possible interference therewith.

It is therefore an object of the present invention to overcome the disadvantages of the prior art.

It is a further object of the present invention to provide a track which may be set up in elongated manner yet be easily shipped, supported and erected.

BRIEF SUMMARY OF THE INVENTION

The present invention comprises an overhead rail system for supporting a display or a signage arrangement in an accommodative manner, from an overhead support such as a ceiling or the like. The overhead rail system comprises a plurality of elongated tracks which are connectable to one another by a connection member arranged there between.

Each elongated track may be comprised of an extruded metal or plastic member having an upper elongated edge portion and a lower elongated edge portion. Each elongated track member is comprised of a pair of elongated parallel sidewalls. Each sidewall has an upper edge consisting of an "L" shaped flange and a lower edge consisting of an "L" shaped flange. Each pair of sidewalls defining the elongated track member are connected to one another by an elongated upper bridge member and an elongated lower bridge member. The upper bridge member and the lower bridge member are spaced apart and parallel to one another, and define between them a middle channel.

The upper "L" shaped flanges and the upper bridge member define between them an elongated, open upper channel. The lower "L" shaped flanges and the lower bridge member define between them an elongated, open lower channel. The upper "L" shaped flanges opposing one another are spaced apart so as to define an elongated open upper slot there between. The lower "L" shaped flanges opposing one another are spaced apart so is to define an elongated open lower slot there between.

The upper bridge member has a lower inwardly directed side with a pair of downwardly and inwardly directed, spaced apart, parallel connector securement flanges arranged thereon. A connector engagement channel is thus disposed between each sidewall and the respective downwardly directed connector securement flanges adjacent the downwardly directed inner side of the upper bridge member.

The lower bridge member has an inwardly, upwardly directed side with a pair of inwardly and upwardly directed, spaced apart, parallel connector securement flanges arranged thereon. A connector engagement channel is disposed between each sidewall and the respective upwardly directed connector securement flanges adjacent the inner upwardly facing side of the lower bridge member.

The open upper channel with its elongated open upper slot and flanges provides a trough for receipt of the lower engagement end of an overhead support member. The open lower channel, with its elongated open lower downwardly facing slot and flanges providing a trough for receipt of the upper engagement end of a display support member.

A thin, elongated connector strip is arranged to be disposed immediately adjacent the inner side walls of the middle channel, having its longitudinal edges snugly received within the upper and lower connector engagement channels at each respective side of the support track middle channel. The elongated connector strip has a plurality of channel wall engagement barbs biased away from the plane of the connector, so as to frictionally engage and bias against the respective inner sidewalls of the support track middle channel. That is, a pair of elongated connector strips are arranged spaced apart and parallel to one another in their respective troughs so as to provide the connective member at the juncture between a pair of elongated, in-line support tracks.

The elongated structural support rails may be supported from an overhead or a ceiling or the like, in a single elongated row of connected tracks, or in a pair of parallel rows of connected tracks connected by intermediate cross-bars or struts fixedly attached between the parallel tracks.

Thus, long arrays of support tracks may be connected to one another to provide a very useful overhead support arrangement, while those same support tracks may be shipped and stored in a shorter and more adaptable arrangement.

The invention thus comprises a system for supporting a display arrangement from an overhead support, comprising: an elongated support rail having an elongated open upper channel for receipt of an overhead support member; an elongated lower channel for receipt of a lower display support member; and an elongated middle channel disposed between the upper channel and the lower channel for aligned, guided and captured receipt of an elongated connector member. The open upper channel is defined by a pair of spaced apart "L" shaped flanges and an upper bridge member arranged between a pair of parallel sidewalls. The open lower channel is defined by a pair of spaced apart "L" shaped flanges and a lower bridge member arranged between the pair of parallel sidewalls. The middle channel has a pair of inwardly facing flanges extending from the upper bridge member and from the lower bridge member toward one another. Each pair of flanges on the upper bridge member and lower bridge member define a connector member receiving channel between the flange and their respective sidewalls.

The invention also comprises a system for permitting an elongated longitudinal array of overhead support tracks to be supported from a ceiling, comprising: an elongated extruded support track for supporting a display panel therefrom, the elongated support track having an elongated upper channel and an elongated lower support channel thereon; an elongated rectilinear middle channel arranged longitudinally between the upper channel and the lower channel, wherein the middle channel has a connection arrangement at each end thereof, to permit a plurality of support tracks to be securely attached thereto, in a linear end-to-end array. The upper channel has an elongated slot extending along an upper side thereof, to permit an overhead track support member to be slidingly received therein. The lower channel has an elongated slot extending along a lower side thereof, to permit a display panel support member to slidingly extend therefrom. The connection arrangement comprises a pair of interior channels defined by sidewalls of the middle channel, and by elongated flanges disposed on both the upper and lower wall surfaces of the middle channel, the interior channels also being disposed adjacent sidewalls and the flanges adjacent the upper and lower corners of the middle channel. The interior channels are arranged to slidingly receive an elongated connection member therein. The elongated connection member has a plurality of outwardly biased fingers extending therefrom, so as to frictionally engage the interior of the sidewalls of the rectilinear middle channel, to permit a plurality of elongated track members to be connected to one another, end-to-end. The overhead track support member has an enlarged lower end for engagement with the upper channel of the elongated support track. The display panel support member has an enlarged upper end for engagement with the lower channel of the elongated support track. The elongated slot in the upper side of the upper channel is defined by a pair of spaced apart "L" shaped flanges defining the upper side of the upper channel. The elongated slot in the lower side of the lower channel is defined by a pair of spaced apart "L" shaped flanges defining the lower side of the lower channel. A plurality of elongated support tracks are connected along a common longitudinal axis, wherein their respective middle channels each have a pair of connector members secured into a set of connector channels within their longitudinally adjacent middle channels.

BRIEF DESCRIPTION OF THE DRAWINGS

The objects and advantages of the present invention will become more apparent, when viewed in conjunction with the following drawings in which.

DETAILED DESCRIPTION OF THE PRESENT INVENTION

Figure 1:
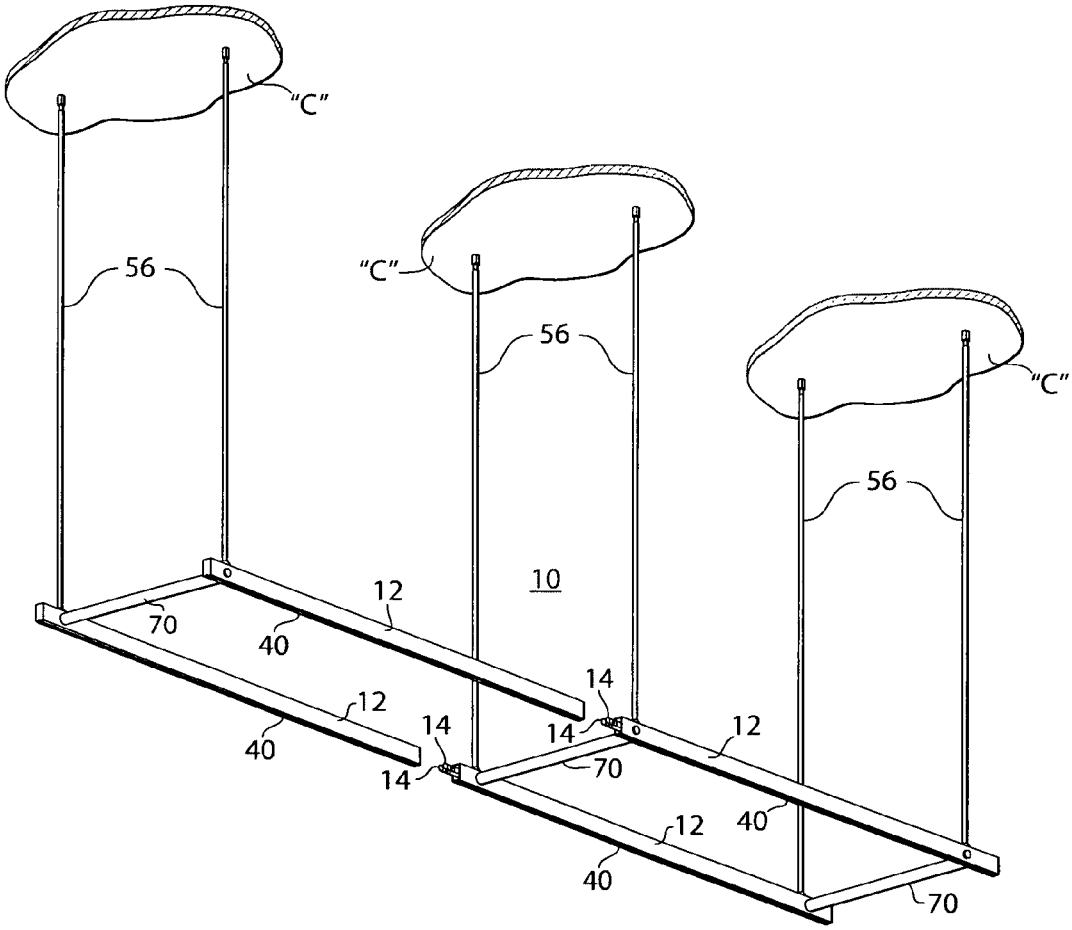
FIG. 1 is an exploded perspective view of a plurality of elongated tracks connected in parallel rows and supported from an overhead.

The present invention comprises an overhead rail system 10 for supporting a display "D" or a signage arrangement in an accommodative manner, from an overhead support such as a ceiling "C" or the like. The overhead rail system 10 comprises a plurality of elongated tracks 12, shown in FIGS. 1, and 4-8, which tracks 12, each for example of a length of about 10 feet, are connectable to one another by a connection member 14, as represented in FIG. 1, the connection member 14 itself, best represented in FIG. 3.

Figure 2:
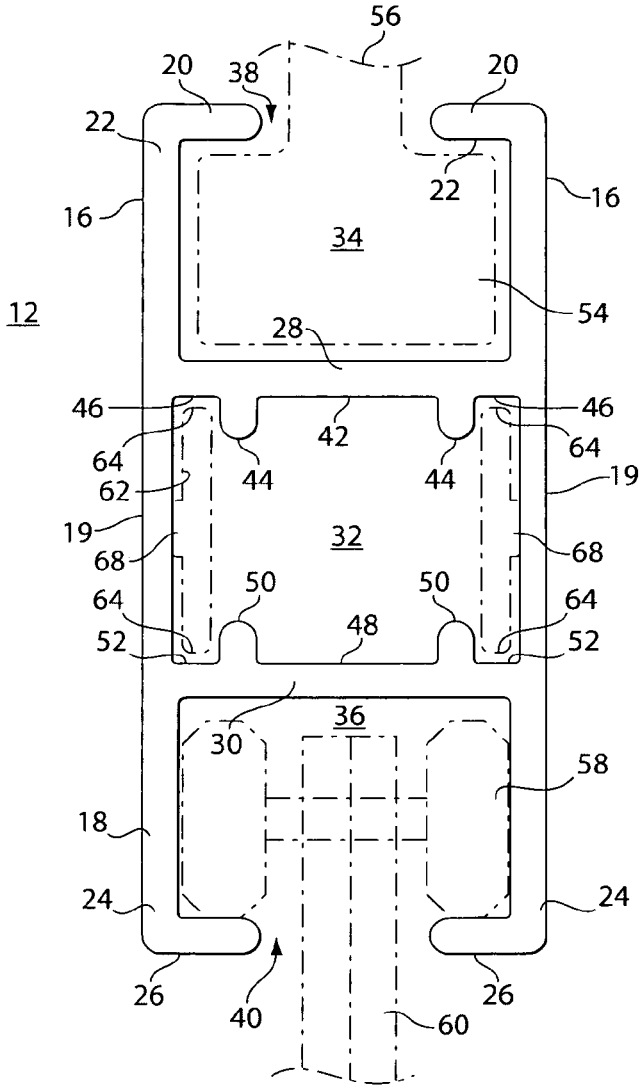
FIG. 2 is a cross sectional view of an elongated support track constructed according to the principles of the present invention.

Each elongated track 12 may be comprised of an extruded metal or plastic member having an upper elongated edge portion 16 and a lower elongated edge portion 18, as best represented in cross-section in FIG. 2. Each elongated track member 12 is comprised of a pair of elongated parallel sidewalls 19. Each sidewall 19 has an upper edge 20 comprised of an "L" shaped flange 22 and a lower edge 24 comprised of an "L" shaped flange 26. Each pair of sidewalls 19 defining the elongated track member 12 are connected to one another by an elongated upper bridge member 28 and an elongated lower bridge member 30, as best represented in FIG. 2. The upper bridge member 28 and the lower bridge member 30 are spaced apart and parallel to one another, and define a middle channel 32 between them.

The upper "L" shaped flanges 22 and the upper bridge member 28 define between them an elongated, open upper channel 34. The lower "L" shaped flanges 26 and the lower bridge member 30 define between them an elongated, open lower channel 36. The upper "L" shaped flanges opposing one another are spaced apart so is to define an elongated open upper slot 38 therebetween. The lower "L" shaped flanges 26 opposing one another are spaced apart so is to define an elongated open lower slot 40 therebetween.

The upper bridge member 28 has a lower inwardly directed side 42 with a pair of downwardly and inwardly directed, spaced apart, parallel connector securement flanges 44 arranged thereon. A connector engagement channel 46 is thus disposed between each sidewall 19 and the respective downwardly directed connector securement flanges 44 adjacent the downwardly directed inner side 42 of the upper bridge member 28, as represented in FIG. 2.

The lower bridge member 30 has an inwardly, upwardly directed side 48 with a pair of inwardly and upwardly directed, spaced apart, parallel connector securement flanges 50 arranged thereon, as represented in FIG. 2. A connector engagement channel 52 is disposed between each sidewall 19 and the respective upwardly directed connector securement flanges 50 adjacent the inner upwardly facing side 48 of the lower bridge member 30.

The open upper channel 34 with its elongated open upper slot 38 and flanges 20 provides a trough for receipt of the lower engagement end 54 of an overhead support member 56, as represented in FIGS. 1, 2, and 4-8. The open lower channel 36, with its elongated open lower downwardly facing slot 40 and flanges 26 provide a trough for receipt of the upper engagement end 58 of a display support member 60.

Figure 3:
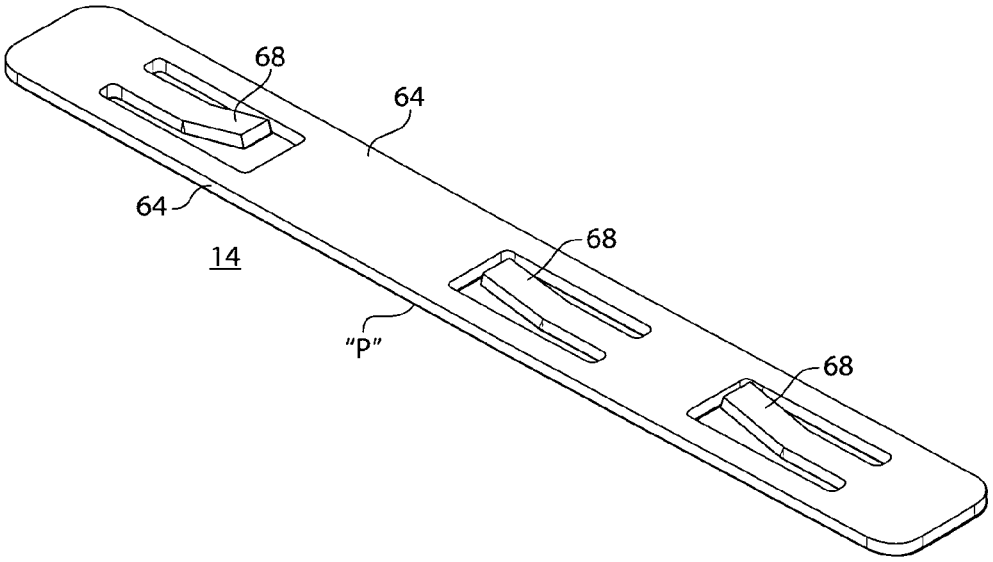
FIG. 3 is a perspective view of an elongated connector strip utilized to join a pair of elongated support tracks together in common "in-line" alignment with one another.
Figure 4:
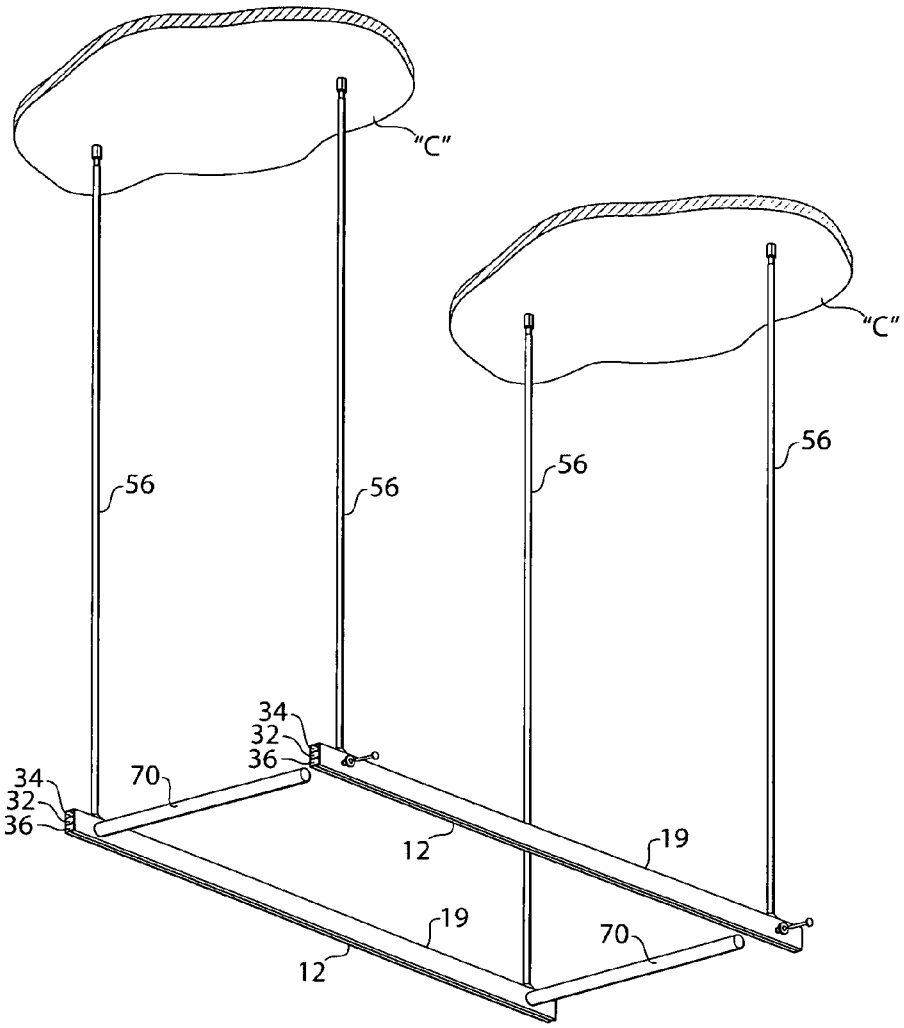
FIG. 4 is a perspective view of a pair of elongated support tracks connected in a parallel, side-by-side relationship from an overhead support.
Figure 5:
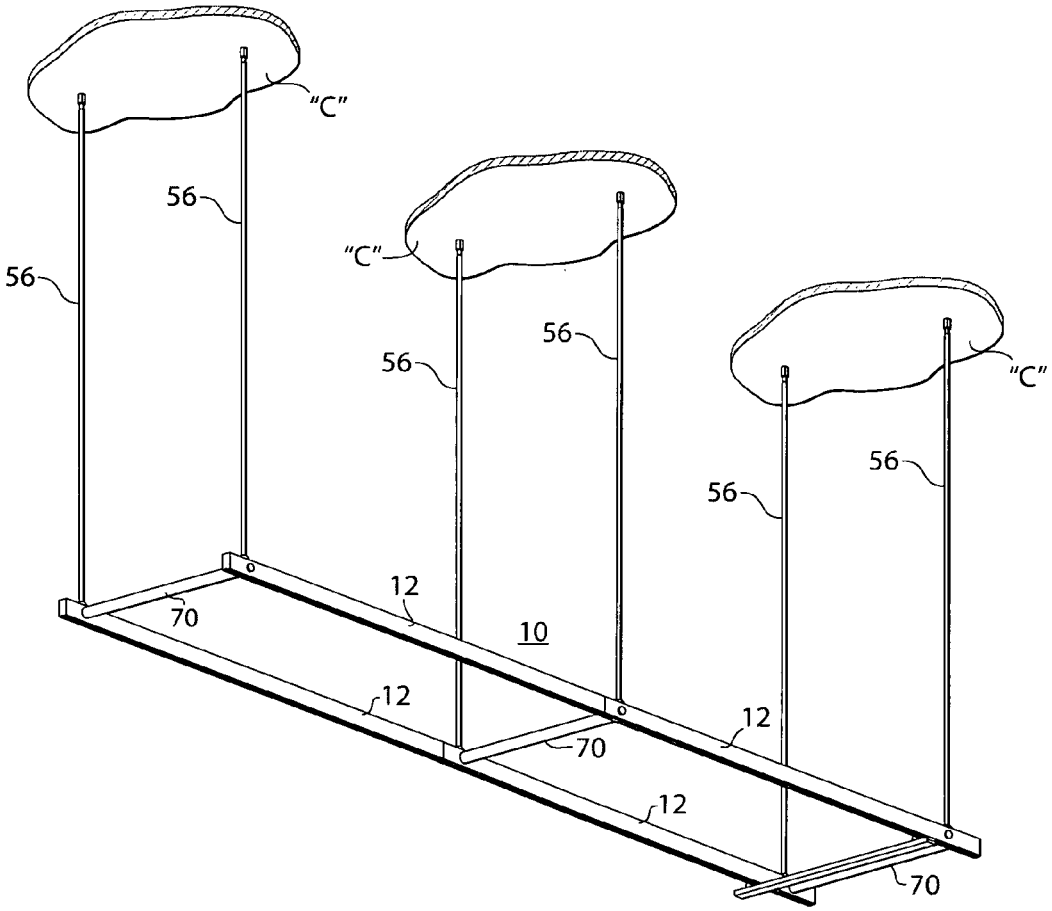
FIG. 5 is a view similar to FIG. 4 showing a multiple track arrangement with a lower support rail attached thereto.
Figure 6:
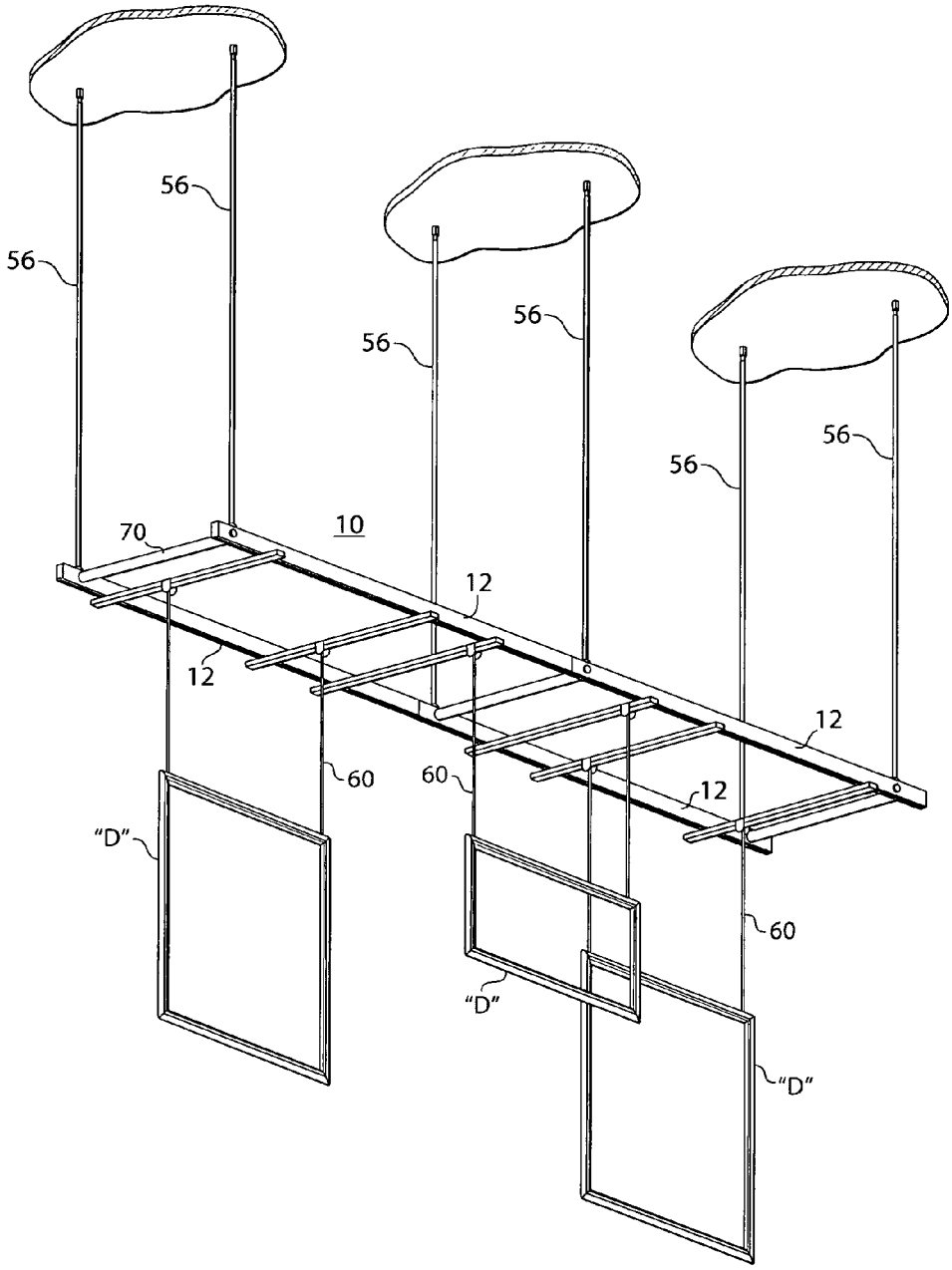
FIG. 6 is a view similar to FIG. 4 showing a parallel array of elongated support tracks supporting a arrangement of display units therefrom.

A thin, elongated connector member 14 is arranged to be guidingly disposed and captured immediately adjacent each of the inner side walls 62 of the middle channel 32, having its longitudinal edges 64 snugly received within the upper and lower connector engagement channels 46 and 52, at each respective side of the support track middle channel 32, as shown in phantom in FIG. 2. The elongated connector member 14 has a plurality of channel wall engagement barbs 68 biased away from the plane "P" of the connector member 14, as represented in FIG. 3, so as to frictionally engage and bias against the respective inner sidewalls 62 of the support track middle channel 32 as represented in phantom in FIG. 2. That is, a pair of elongated connector members 14 or strips are arranged spaced apart and parallel to one another in their respective troughs so as to provide the connective member at the juncture between a pair of elongated, in-line support tracks 12, as represented in FIG. 1.

Figure 7:
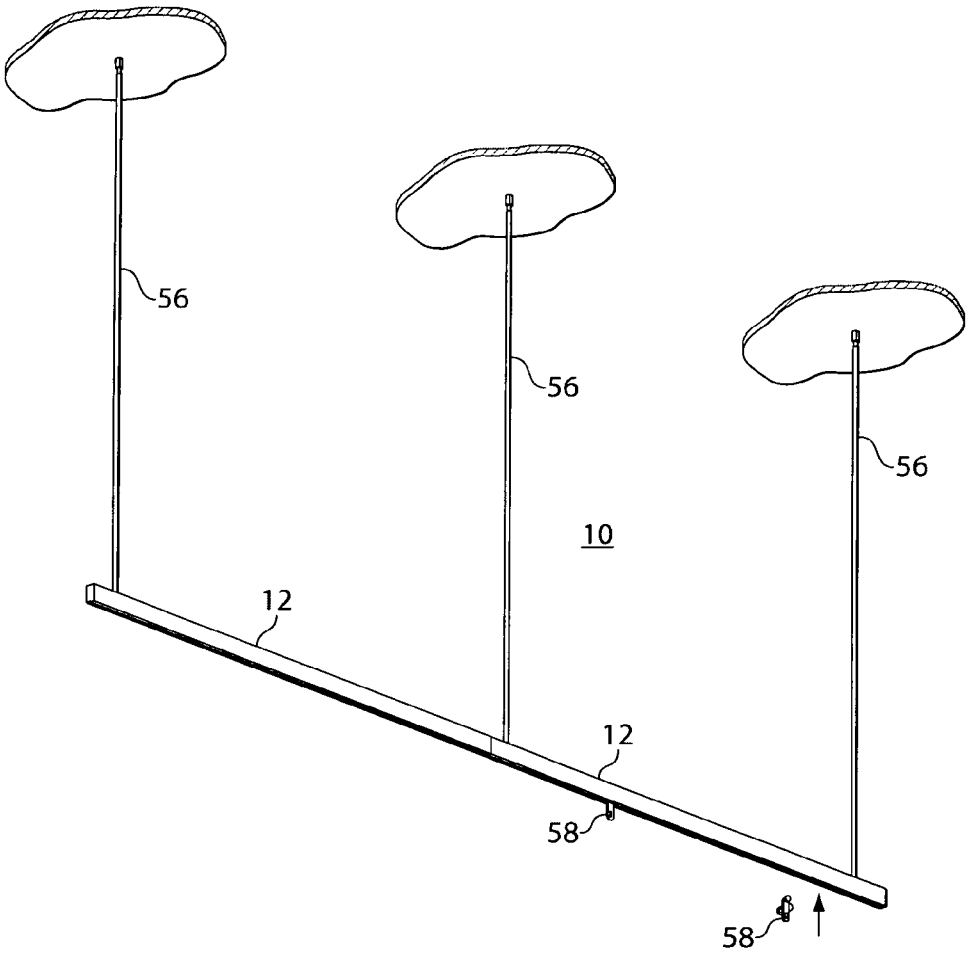
FIG. 7 is a perspective view of the role of support tracks supported from an overhead with a lower display attachment member arranged therewith.
Figure 8:
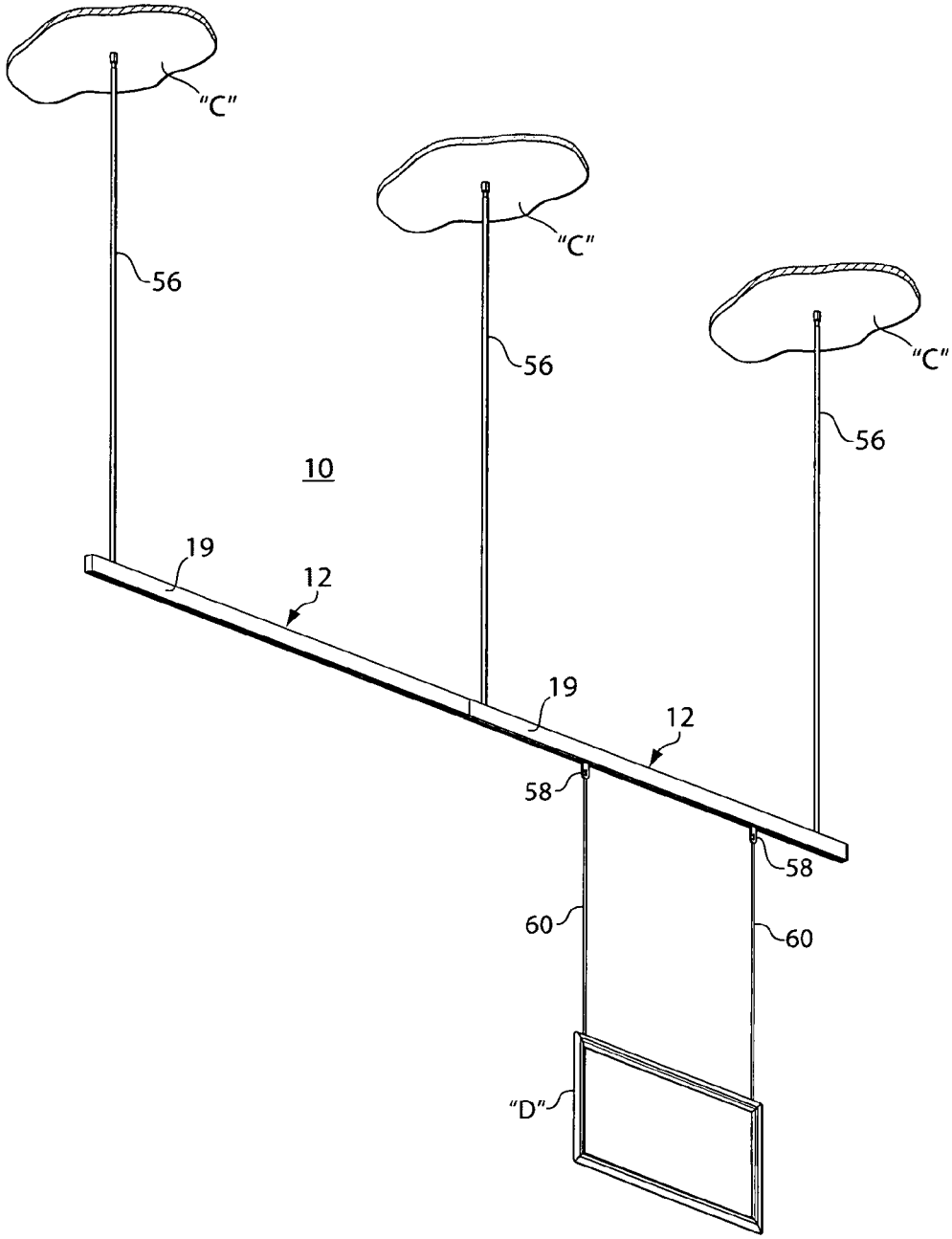
FIG. 8 is a view similar to FIG. 7 showing a single array of elongated track members supporting a display panel therebeneath.

The elongated structural support rails 12 may be supported from an overhead or a ceiling "C" or the like, in a single elongated row of connected tracks 12 as represented in FIG. 7, or in a pair of parallel rows of connected tracks 12 connected by intermediate cross-bars or struts 70 fixedly attached between the parallel tracks 12, as represented in FIGS. 1, 4, 5 and 6.

Thus, long arrays of support tracks 12 may be connected to one another to provide a very useful overhead support arrangement, while those same support tracks 12 may be shipped and stored in a shorter and more adaptable arrangement.

We claim:

1. A system supporting a display arrangement from an overhead support, comprising:

an elongated support rail having an elongated open upper channel receiving an overhead support member;

an elongated open lower channel for receipt of a lower display support member;

an elongated middle channel disposed between the upper channel and the lower channel for enabling the receipt of aligned, guided capture of a pair of thin, transversely-spaced-apart, separate and independent, frictionally-engaging, elongated, middle-channel-barbed support track connector members to permit a similar minimal-weight-connection to another elongated support rail; wherein the system also includes at least two elongated support rail overhead support members, each of the two overhead support members having a lower end in sliding supportive engagement with the elongated open upper channel arranged to provide balanced support of the elongated support rail from above the elongated support rail, and at least two lowermost support members, each of the two lowermost support members having an upper end in sliding supportive engagement with the elongated open lower channel, the two lowermost support members arranged to provide balanced support of a display panel supported beneath the elongated support rail; wherein the system further includes at least one pair of the thin, transversely-spaced-apart, frictionally-engaging, separate and independent, elongated middle-channel-barbed support track connector members to permit the similar, snug, minimal-weight-connection to an elongated support rail attachment linearly thereadjacent.

2. The system for supporting the display arrangement from the overhead support as recited in claim 1, wherein the open upper channel is defined by a pair of spaced apart "L" shaped flanges and an upper bridge member arranged between a pair of parallel sidewalls.

3. The system for supporting the display arrangement from the overhead support as recited in claim 2, wherein the open lower channel is defined by a pair of spaced apart "L" shaped flanges and a lower bridge member arranged between the pair of parallel sidewalls.

4. The system for supporting the display arrangement from the overhead support as recited in claim 2, wherein the middle channel has a pair of inwardly facing flanges extending from the upper bridge member and from the lower bridge member toward one another on each side thereof to permit the at least one pair of thin, transversely-spaced-apart, frictionally-engaging, separate and independent, elongated middle-channel-barbed support track connector members to enable the similar, snug, minimal-weight-connection to an elongated support rail attachment linearly thereadjacent.

5. The system for supporting the display arrangement from the overhead support as recited in claim 4, wherein each pair of flanges on the upper bridge member and lower bridge member define a connector member receiving channel between the flanges and their respective sidewalls.

6. A system for permitting an elongated longitudinal array of overhead support tracks to be supported from a ceiling, comprising:

an elongated extruded support track for supporting a display panel therefrom, the elongated support track having an elongated open upper channel and an elongated lower support channel thereon;

the elongated extruded support track including an elongated rectilinear middle channel arranged longitudinally between the upper channel and the lower channel, wherein the middle channel has a connection arrangement at each end thereof, to permit a plurality of corresponding support tracks to be securely attached thereto, in a linear, end-to-end array, wherein the connection arrangement comprises a pair of interior connector-receiving slots or channels defined by sidewalls of the middle channel, and by vertically disposed elongated flanges disposed on both inwardly facing upper and lower wall surfaces of the middle channel, the interior channels also being disposed adjacent sidewalls and the flanges adjacent the upper and lower corners of the middle channel, to define two separate, thin, elongated connector-receiving-slots and wherein the interior connector-receiving slots are arranged to each independently slidingly receive one of a pair of transversely spaced apart, thin, separate and independent, elongated connection members therein, and wherein each of the elongated connection member has a plurality of outwardly biased fingers extending therefrom, so as to frictionally engage the interior of the sidewalls of the rectilinear middle channel, to permit a plurality of elongated support track members to be connected to one another, end-to-end, with linear, adjacent, open upper channels, the system including said pair of transversely spaced apart, thin, separate and independent elongated connection members for linearly connecting a an elongated second support track thereto.

7. The system as recited in claim 6, wherein the upper channel has an elongated slot extending along an upper side thereof, to permit an overhead track support member to be slidingly received therein.

8. The system as recited in claim 7, wherein the lower channel has an elongated slot extending along a lower side thereof, to permit a display panel support member to slidingly extend therefrom.

9. The system as recited in claim 7, wherein the overhead track support member has an enlarged lower end for engagement with the upper channel of the elongated support track.

10. The system as recited in claim 8, wherein the display panel support member has an enlarged upper end for engagement with the lower channel of the elongated support track.

11. The system as recited in claim 7, wherein the elongated slot in the upper side of the upper channel is defined by a pair of spaced apart "L" shaped flanges defining the upper side of the upper channel.

12. The system as recited in claim 8, wherein the elongated slot in the lower side of the lower channel is defined by a pair of spaced apart "L" shaped flanges defining the lower side of the lower channel.

13. The system as recited in claim 6, wherein a plurality of elongated support tracks are connected along a common longitudinal axis, wherein their respective middle channels each have said pair of elongated connection members secured into a set of connector channels within their longitudinally adjacent middle channels.

* * * * *